United States Patent [19]

Nakada

[11] 4,270,580

[45] Jun. 2, 1981

[54] METHOD AND APPARATUS FOR WEAVING WEB

[75] Inventor: Kiyoshi Nakada, Nyuzen, Japan

[73] Assignee: Yoshida Kogyo K.K., Tokyo, Japan

[21] Appl. No.: 80,704

[22] Filed: Oct. 1, 1979

[30] Foreign Application Priority Data

Oct. 9, 1978 [JP] Japan ..... 53-124291

[51] Int. Cl.[3] ..... D03D 47/42

[52] U.S. Cl. ..... 139/431

[58] Field of Search ..... 139/191 R, 431, 432

[56] References Cited

U.S. PATENT DOCUMENTS 2,497,077 2/1950 Firing et al. ..... 139/431

*Primary Examiner*—Henry Jaudon

*Attorney, Agent, or Firm*—Hill, Van Santen, Steadman, Chiara & Simpson

[57] ABSTRACT

Disclosed herein are a method for weaving webs, such as tapes of slide fasteners and a loom used for achieving the method. The method comprises a process of urging a woven web so as to shift the path of the web to a place close to a latch needle of a loom so that loops of a filling formed between the latch needle and the adjacent edge of the web are small. The loom includes a ramp on a table on which a woven web is fed. The direction of the inclination of the ramp is perpendicular to the feeding direction of the web and it descends as it goes toward the latch needle.

2 Claims, 8 Drawing Figures

METHOD AND APPARATUS FOR WEAVING WEB

BACKGROUND OF THE INVENTION

This invention relates to a method and an apparatus for weaving webs such as tapes used for slide fasteners. More specifically, the invention relates to improved method and apparatus which can weave a web with small loops of a filling formed between a latch needle and the adjacent edge of the web.

Needle looms are well known in the art and have been accepted commercially. In a conventional needle loom, a filling carrier is placed at one side of a bunch of warp ends and adapted to reciprocally swing so as to deliver a filling through each of successive sheds from one side to the other of the bunch of the warp ends. At the other side, a latch needle is provided to pick up the filling. The filling carrier and the latch needle cooperate so that a segment of the filling extends through each shed from one side of the warp end bunch to the latch needle at the other side and then back to the one side of the same. In the conventional needle looms, latch needles can not be placed close to the adjacent edges of the woven webs, since the one in each bunch of warp ends closest to a latch needle interferes with the reciprocal movement of the latch needle placed close to the adjacent edge of a web. Therefore, loops formed between the latch needle and the edge of the web are necessarily large. The large loops not only make the edge of the woven web rough but also make the knitting action of the latch needle unreliable, since removal of loops from the needle is not facilitated by large loops.

SUMMARY OF THE INVENTION

Therefore, an object of this invention is to provide a method of weaving webs such as tapes used for slide fasteners which can weave a web with small loops of a filling formed between a latch needle and the adjacent edge of a web, thereby eliminating the shortcoming associated with the large loops in the conventional weaving process using needle looms.

Another object of the invention is to provide an apparatus for achieving the abovementioned method.

According to the invention, a woven web is urged toward a latch needle as it is supported and fed on a guide table. A ramp is formed on the guide table, the direction of inclination of which is perpendicular to the feeding direction of the web and it descends as it goes toward the latch needle so that the force imparted from the ramp to the web urges the web toward the latch needle.

DESCRIPTION OF THE DRAWINGS

Further objects and advantages of the invention will become apparent from the following detailed explanation of the conventional weaving manner and description of a preferred embodiment of this invention referring to the drawings, in which.

DESCRIPTION OF THE PREFERRED EMBODIMENTS

Figure 1:
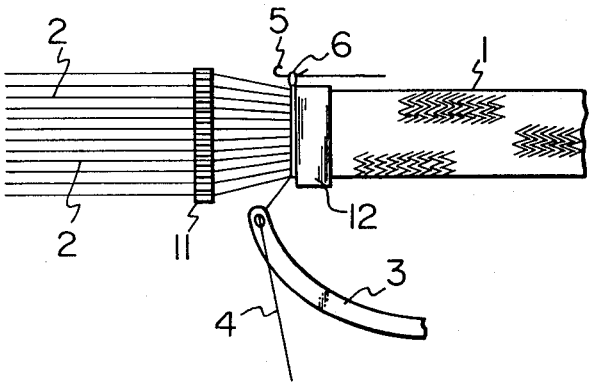
FIG. 1 is a schematic illustration of a conventional needle loom showing the weaving mechanism thereof.

FIG. 1 is a schematic illustration of a conventional needle loom showing a portion around the cloth fell between warp ends 2 and a fastener tape 1 being woven by the loom. The warp ends 2 are fed from an unshown warp beam and the tape is drawn by an unshown taking up means. Harnesses (not shown) are provided so that one harness grasps one group of the warp ends consisting of alternate ones of the warp ends 2 and the other harness grasps the other group of the warp ends consisting of the remaining ends. The harnesses are vertically and reciprocally movable to successively form sheds between the two groups of the warp ends. A filling carrier 3 swings through each shed so that it delivers a filling 4 from one side of the bunch of the warp ends 2 to the other. At the other side of the bunch, there is provided a latch needle 5 which picks up the filling 4 brought there by the filling carrier 3. Therefore, once the filling carrier 3 completes its reciprocal cycle, a segment of the filling 4 is threaded through the shed so as to extend from one side to the other of the warp end bunch and from the other back to one side of the same. A reed 11 beats the segment of the filling 4 against the cloth fell to regulate the concentration of the filling segments. Then, the group of upper warp ends and the group of lower warp ends change places to form a loop between the latch needle 5 and the adjacent edge of the tape 1.

Figure 1A:
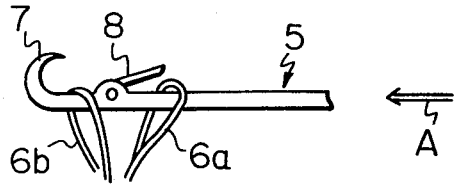
FIGS. 1A and 1B are partial views of a latch needle showing the operation thereof.
Figure 1B:
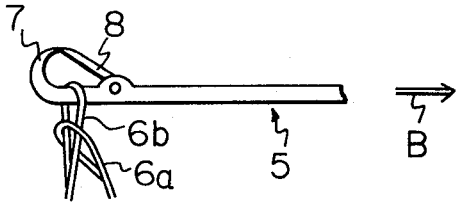

The latch needle 5 includes a hook portion 7 and a pivotable latch 8 and is reciprocally moved in a well known fashion so that when it moves forward as indicated by arrow A in FIG. 1A the preceding loop 6*a* comes off the latch 8 and when it moves rearward as shown by arrow B in FIG. 1B the preceding loop 6*a* overrides the latch 8 and the hook 7 so that the last formed loop 6*b* extends through the preceding one. By this knitting operation of the latch needle 5, the filling 4 is prevented from getting loose. Numeral 12 indicates a pressing roller for holding the tape 1 for preventing unstable lateral movement of the tape.

In a conventional loom, such as one shown in FIG. 1, tension working in the warp ends 2 at the portion between the reed 11 and the cloth fell are symmetrical with respect to the center line of the reed 11. Therefore, the woven tape 1 is automatically placed so that the centerline thereof aligns with the centerline of the reed 11. Since the warp ends 2 diverge from the cloth fell towards the reed as shown in FIG. 1 and the warp ends must be in the path of reciprocal movement of the latch needle 5 for preventing breakage of the warp ends, there must be certain distance between the latch needle 5 and the adjacent edge of the tape 1. This results in large loops between the tape edge and the latch needle 5 and the large loops make the edge of the woven tape 1 rough. Furthermore, the large loops increases the distance across which the latch needle 5 reciprocates, thereby causing a problem of vibration. Moreover, the knitting operation is not reliable.

Figure 2:
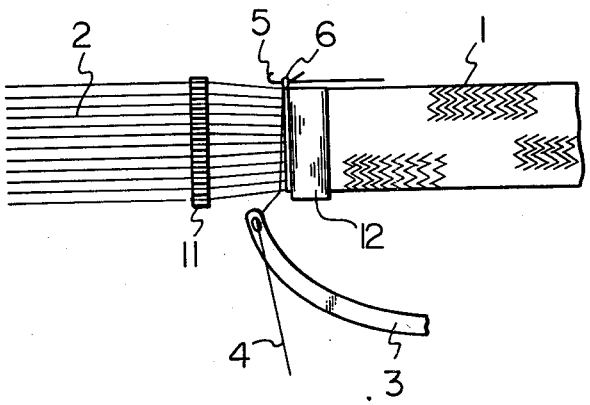
FIG. 2 is a schematic illustration corresponding to FIG. 1 in which tension in a filling is intentionally decreased.

One possible approach for making the loops small is to decrease the tension of the filling. As shown in FIG. 2, decreased tension in the filling 4 makes the tape 1 wider. Therefore, the edge of the tape 1 is placed closer to the latch needle 5. However, because of the decreased tension of the filling, the edge adjacent the latch needle 5 is still rough. Even the opposite edge also becomes rough and the texture of the tape 1 is loosened. Although not shown in the drawings, another approach is to tighten the filling to the extent that the warp ends are drawn toward the latch needle. However, this approach increases the possibility of breakage of the latch needle and the filling.

Figure 3:
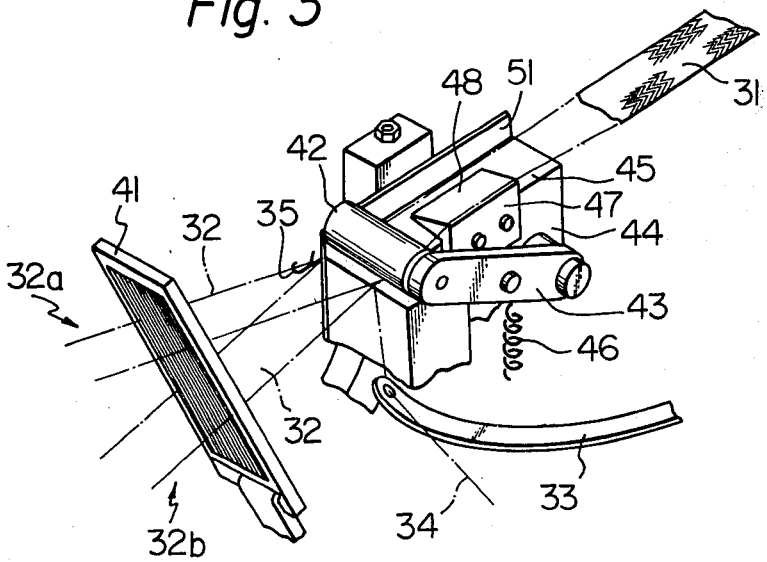
FIG. 3 is a perspective view of a needle loom according to an embodiment of the invention.
Figure 4:
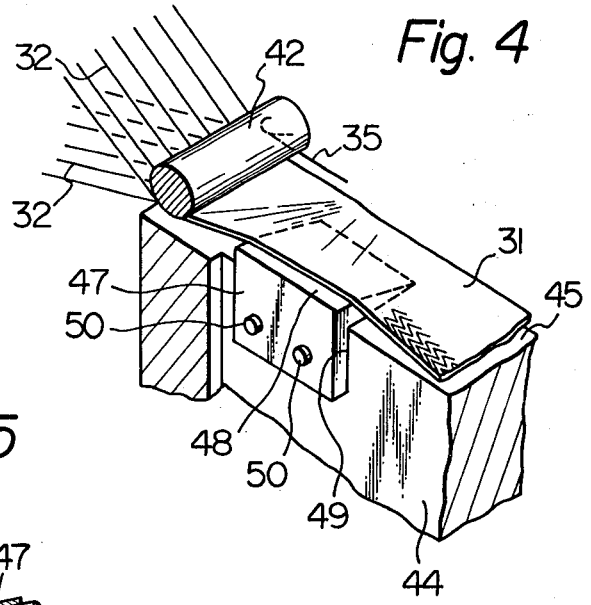
FIG. 4 is a perspective view of the needle loom of FIG. 3 seen from another aspect with a guard plate removed for showing a latch needle.

FIGS. 3 to 6 show one embodiment of this invention. Numerals 32*a* and 32*b* show a group of alternate ones of warp ends 32 and a group consisting of the other warp ends, respectively. The warp ends of each group are held by a harness (not shown) so that the groups alternatively move upward and downward to successively form sheds. A pressing roller 42 is rotatably mounted on an arm 43 at one end thereof, the arm being in turn pivotally mounted at the other end on a member 44 which defines a guide table 45 by the upper surface thereof. The arm is biased by a spring 46 so that the roller 42 is pressed on the table 45. Reference numerals 33, 35 and 41 indicate a filling carrier, latch needle and a reed, respectively. The structure and operation of the abovementioned elements in FIG. 3 are conventional and the same as those of the corresponding elements explained with respect to FIG. 1. Therefore, no additional explanation is believed to be necessary. According to the invention, means is provided for urging a tape 31 toward the latch needle 35 so as to shift the path of the tape to the place close to the latch needle. The means comprises a block 47 having at the upper surface thereof a ramp 48. The block is received in a recess 49 (FIG. 4) formed in the table defining member 44 so that the direction of the inclination is perpendicular to the feeding direction of the tape 31 and it descends as it goes toward the latch needle 35. The block 47 may be fastened to the member 44 by suitable means such as screws 50. At the side of the table defining member 44 adjacent the latch needle 35, there is provided a guard plate 51 which prevents the tape 31 from contacting the latch needle 35 by accident.

Figure 5:
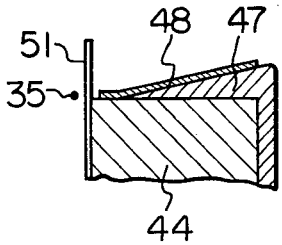
FIG. 5 is a cross sectional view of a table defining member shown in FIG. 3.
Figure 6:
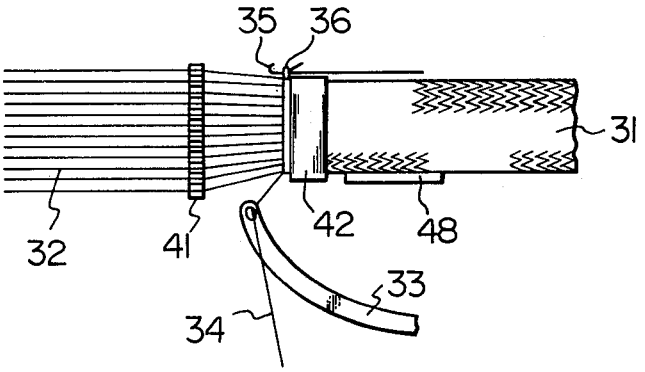
FIG. 6 is a schematic illustration of a plan view of the needle loom shown in FIG. 3.

As the woven tape 31 is fed on the table 45, it is urged toward the latch needle 35 by the effect of the ramp as best shown in FIG. 5. By this urging action, the path of the tape 31 is shifted from the center of the reed 41 to a place close to the latch needle 35, thereby making the distance between the latch needle and the adjacent edge of the tape at the cloth fell small. This results in small loops 36 between the latch needle 35 and the edge of the tape 31.

Due to the small loops, the edge of the tape 31 becomes neat. Furthermore, since the distance across which the latch needle 35 reciprocates for the knitting operation may be short, the working speed of the loom can be increased without causing a problem of vibration. It will be appreciated that these advantages can be obtained without changing the tension in the filling from a conventionally accepted value and thus without increasing possibility of breakage of the filling or causing a loose fabric in the obtained tape.

What is claimed is:

1. A needle loom including a member defining a table on which a woven web is supported; a filling carrier disposed at one side of the table defining member so as to swing through successive sheds formed by warp ends in the upstream of the woven web; and a latch needle disposed at the other side of the table defining member, said filling carrier and latch needle being so adapted that a segment of a filling is extended through each shed from said one side to the other and picked up by said latch needle there and then back to said one side, characterized in that a ramp is formed on said table for biasing the woven web to the latch needle, said ramp inclining in the direction perpendicular to the feeding direction of the woven web so that it descends as it goes toward the latch needle.

2. A needle loom according to claim 1 further characterized in that a recess is provided in the table defining member and said ramp is defined by an inclined upper surface of a block received in said recess.

* * * * *